United States Patent [19]

Davis et al.

[11] 4,147,923

[45] Apr. 3, 1979

[54] ELECTRICAL FILTERED AIR HEATER

[76] Inventors: Oliver T. Davis, Rte. 1, Box 257; Norman R. Jones, Rte. 2, both of Dunlap, Tenn. 37327

[21] Appl. No.: 842,239

[22] Filed: Oct. 14, 1977

[51] Int. Cl.[2] ..... H05B 3/00; F24H 3/10; F28F 9/00

[52] U.S. Cl. ..... 219/368; 219/360; 219/369; 219/379; 219/380; 219/381

[58] Field of Search ..... 219/367–369, 219/370, 373, 379, 380, 306, 314, 315, 360; 62/401; 137/171, 314, 341

[56] References Cited

U.S. PATENT DOCUMENTS

| | | | |
|---|---|---|---|
| 1,825,793 | 10/1931 | Heroy | 219/306 |
| 2,015,288 | 9/1935 | Rosen | 62/401 |
| 2,042,264 | 5/1936 | Levenhagen | 219/273 |
| 2,438,865 | 3/1948 | Rehard | 219/368 |
| 2,711,472 | 6/1955 | Bowen | 219/314 |
| 2,716,289 | 8/1955 | Lauck | 62/401 |
| 3,737,626 | 6/1973 | Davis et al. | 219/360 |

*Primary Examiner*—J. V. Truhe
*Assistant Examiner*—Bernard Roskoski

[57] ABSTRACT

An electrical heater is disclosed capable of producing dry, clean, heated compressed air having a housing with spaced apart end compartments and a heating unit mounted between the compartments. Regulated compressed air is caused to circulate through a plurality of chambers formed by tubes enclosing the heating unit where moisture is removed before it is passed to a filtered outlet. The moisture is collected in one of the compartments and automatically drained therefrom when the heater is not in use. A temperature responsive sensing element in the path of the circulating compressed air controls the degree of energization of the heating unit.

10 Claims, 3 Drawing Figures

ELECTRICAL FILTERED AIR HEATER

BACKGROUND OF THE INVENTION

1. Field of the Invention

The present invention relates to improvements in heaters for compressed air and more particularly with a self-contained electric heating means to which compressed air is admitted, heated and the moisture removed before it is filtered of impurities and delivered to a point of use.

2. Prior Art and Objects

This invention is an electrical filtered air heater which is an improvement over the air heater disclosed in our U.S. Pat. No. 3,737,626. In its specific aspects, the air heater of the present invention provides a cylindrical shaped housing having upper and lower compartments interconnected by concentric tubes forming passageways for the compressed air. An electric heating unit is positioned within the innermost concentric tube to heat the compressed air. The upper compartment serves as a housing for the thermostatic controls and the like and the lower compartment serves as a reservoir for condensation removed from the air during its passage. The reservoir holds the water when the device is in use and permits it to drain therefrom when the device is not in use. A regulator controls the pressure of the air entering the device and a filter removes any impurities or remaining moisture as the heated air exist the device.

The thermostatic controls maintain the temperature of the air leaving the heater at a preselected valve by controlling the degree of energization of the heating unit. As a result of the novel improvements in the present air heater over the disclosed structure in our aforementioned patent, the present air heater can efficiently handle as much as twelve times the volume of air as our previously patented device.

The main object of the invention is the provision of an electric heater which will produce large volumes of hot, clean dry compressed air to a point of use.

Another object of the invention is the provision of a heating unit for compressed air which is capable of removing and storing a large quantity of condensed moisture removed from the air when the device is in operation and which automatically drains the condensate when the device is not in operation.

It is yet another object to provide such a compressed air heater which is compact and easily mounted in its vertical operating position adjacent the source of compressed air elsewhere.

It is a still further object to provide a compressed air heater which is novel in its construction and relatively inexpensive to manufacture.

The novel features which are believed to be characteristic of the invention, both as to its organization and method of operation, together with further objectives and advantages thereof will be better understood from the following description considered in connection with the accompanying drawing in which a presently preferred embodiment of the invention is illustrated by way of example. It is to be expressly understood however, that the drawing is for the purpose of illustration and description only, and is not intended as a definition of the limits of the invention.

DETAILED DESCRIPTION OF PREFERRED EMBODIMENT

Figure 2:
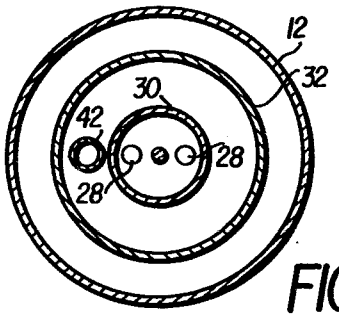
FIG. 2 is a cross sectional view of the heater of FIG. 1 taken along the lines A—A.
Figure 3:
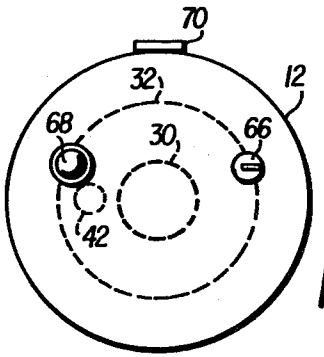
FIG. 3 is a plan view of the heater of FIG. 1.
Figure 1:
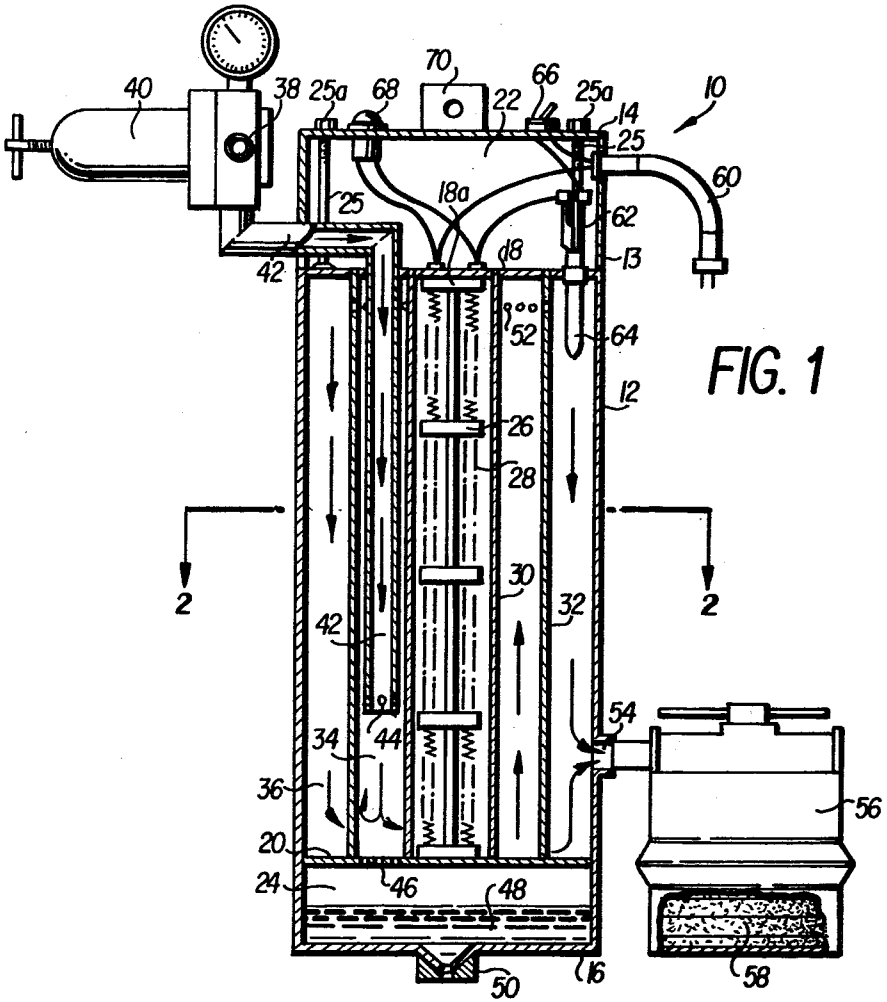
FIG. 1 is a cross sectional view of the compressed air heater of the present.

Referring now to the drawings where similar characters of reference indicate like elements in each of the several figures, numeral 10 indicates generally the compressed air heater of the invention. The heater 10 comprises a main body portion 12 and a cap 13. The cap 13 has an end wall 14 and the main body portion 12 has an end wall 16. It will be understood that the cap 13 is removable to facilitate the repair of various parts of the heater. Internal spaced apart partitions 18, 20 are provided within the housing 12 to form end compartments 22, 24 respectively. Bolts 25 are welded at one end to partition 18 and extend up through end wall 14 where nuts **25*a* serve to hold the cap 13 to the main body portion 12**. The purpose of the partitions and compartments will be more fully described later.

An electric heating unit 26 consisting of resistance-type spiral heating element wire 28 extends centrally and longitudinally of the housing 12. The heating unit 26 is secured to a disc **18*a* which forms an aperture in partition 18. The heating unit 26 may also be secured to partition 20 if the entire device is secured to vibrating machinery or the like and rigidity is necessary. The partitions 18, 20 are secured to the inside of housing 12** by welding or the like to form a water-tight seal.

A first cylindrical shaped metal tube 30 is located around the heating unit 26 and is concentric and coextensive therewith. The tube 30 radiates heat absorbed from adjacent heating unit 26 along its entire length. A second cylindrical-shaped metal tube 32 is concentric and coextensive with and spaced apart from cylindrical tube 30 to form a first cylindrical-shaped chamber 34 and a second cylindrical shaped chamber 36. The tubes 30, 32 are welded to partitions 18, 20 respectively to insure watertightness between the tubes.

The inlet 38 of pressure regulator 40 is connected to a source of compressed air. (not shown). The air heater inlet pipe 42 from the pressure regulator 40 extends into compartment 22, through partition 18 and into first chamber 34 a distance past the midpoint of the heating unit 26. The pressure regulator 40 serves to limit the pressure of the air entering the device to a preselected amount commensurate with the burst limit designed into the overall device.

The partition 20 has an aperture 46 therethrough into second chamber 36. The aperture 46 is located substantially beneath the outlet 44 of inlet tube 42 and it acts as a drain for water which condenses on the inside surface of inlet pipe 42 as well as the walls of the first and second cylindrical shaped tubes 30, 32 forming the first chamber 34. The condensate 48 is stored in the second compartment 24 which is watertight. A valve 50 located on end wall 16 is normally open to permit the condensate to drain therefrom when no air pressure is exerted on the condensate such as when the heating device 10 is not in operation. However, when the device 10 is in operation, air under pressure acts on the condensate 48 and the valve 50 is maintained in its closed position.

A plurality of apertures 52 are provided around the periphery of second cylindrical shaped tube 32 to permit air circulating and being warmed in first chamber 34 to enter second chamber 36. The compressed air passes through second chamber 36 to outlet 54. Intermediate the outlet 54 and the point of intended use is a filter 56 for removing any remaining impurities or small quantities of moisture which may remain in the heated air. The filter 56 contains a series of filter elements 58 which may be replaced as they become clogged or inoperable. Although the greatest amount of moisture is removed within the device, the filter 56 is important to the invention when very dry heated air is required such as in a high grade spray painting or other industrial, commercial or laboratory applications.

The heating unit 26 is energized by electric current fed to cable 60 entering compartment 22. The electric current is fed in series to a thermostatically activated switch 62 associated with a temperature sensing means 64 mounted on partition 18. The temperature sensing means 18 is adjacent to and in the path of the heated air exiting apertures 52 for more accurate temperature sensing. Also in series with the thermostatically activated switch 62 is an on-off switch 66 mounted on end wall 14 for controlling the operation of the entire device. A light 68 is also mounted on end wall 14 and connected in a parallel circuit with heating unit 26 to give a visual indication when the compressed air heater is in operation. A bracket 70 is also provided to mount the compressed air heater in a vertical position on a wall or a piece of machinery such as the compressor for delivering the compressed air to the device.

In operation, compressed air in large volumes is delivered to the inlet 38 of pressure regulator 40. The inlet 38 diameter can be, on this device, as great as three-fourths of an inch whereas the inlet of the device set forth in my aforementioned patent was one-fourth of an inch. The pressure regulator 40 is adjusted to maintain the pressure of the air in the device as well as that at the outlet at a predetermined amount. The switch 66 is thrown to energize the heating unit 26 and heat first cylindrical-shaped tube 30. Heat radiating from the first tube 30 also heats inlet tube 42. Moisture laden air under pressure enters inlet tube 42 and from there through aperture 46 into compartment 24 where it closes drain valve 50. The air then becomes heated in its passage in the first chamber 34 and moisture in the air is caused to condense on the surface of second tube 32 opposite tube 30. The condensate rolls down the tube 32 to partition 20 and through the aperture 46 into compartment 24. The dry air then flows through aperture 52 into second chamber 36 where its temperature is sensed by temperature sensing means 64. Passage of the air through second chamber 36 slightly cools the air on its way to outlet 54. From outlet 54 the heated, dry air enters filter 56 where remaining amounts of debris and moisture is removed before it exist the filter 56 for use. When the pressure of the air in first chamber 34 is substantially atmospheric, the drain valve 50 opens and the collected condensate 48 from compartment 24 can drain out.

The foregoing is considered illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention.

What we claim is:

1. A heater adapted to provide dry, clean and heated air comprising:

(a) a housing having end walls and apertured means forming transverse spaced apart partitions forming first and second compartments, (b) an electric heating unit located centrally and longitudinally of said housing, (c) a first tube enclosing said heating element, (d) a second tube enclosing said first tube, said first and second tubes extending between said spaced apart partitions to form a first chamber between said first and second tubes, said second compartment serving as a storage means for condensation formed in said first chamber and a second chamber between said second tube and said housing, said second tube having a plurality of apertures therethrough connecting said second chamber with said first chamber, (e) inlet means for admitting compressed air into said first chamber, (f) outlet means for removing said compressed air from said second chamber, and (g) electrical control means for controlling the degree of energization of said heating unit in response to the temperature inside said second chamber.

2. A heater as set forth in claim 1 wherein said control means is mounted on said partition forming said first compartment and said control means extends into said second chamber adjacent a number of said apertures to more accurately sense the temperature of said air entering said second chamber through said apertures.

3. A heater as set forth in claim 1 wherein said partition forming said second compartment has an aperture therethrough connecting said first chamber with said second compartment to permit said condensation formed in said first chamber to flow into said second compartment.

4. A heater as set forth in claim 3 wherein said second compartment has drain means which is closed to prevent condensation from leaving said second compartment when said compressed air is present in said first chamber and which is open to drain said condensation from said second compartment when no compressed air is in said first chamber.

5. A heater as set forth in claim 1 wherein said inlet means comprises a pipe which extends through said housing, through said partition forming said first compartment and into said first chamber.

6. A heater as set forth in claim 5 wherein said inlet pipe extends beyond the midpoint of said first tube.

7. A heater as set forth in claim 1 wherein said first tube is concentric with said heating unit and said second tube is concentric with said first tube.

8. A heater as set forth in claim 1 wherein said heating unit is mounted on at least one of said partitions.

9. A heater as set forth in claim 1 wherein said inlet means has pressure regulator means connected thereto.

10. A heater as set forth in claim 1 wherein said outlet means has filter means connected thereto.

* * * * *